US006619475B2

(12) United States Patent
Chang

(10) Patent No.: US 6,619,475 B2
(45) Date of Patent: Sep. 16, 2003

(54) GOLF BAG WITH HONEYCOMB CELL STRUCTURE

(76) Inventor: David Chang, 16455 Garvin Dr., Encino, CA (US) 90436

( * ) Notice: Subject to any disclaimer, the term of this patent is extended or adjusted under 35 U.S.C. 154(b) by 0 days.

(21) Appl. No.: 10/104,687

(22) Filed: Mar. 21, 2002

(65) Prior Publication Data

US 2002/0170839 A1 Nov. 21, 2002

Related U.S. Application Data

(63) Continuation-in-part of application No. 09/603,803, filed on Jun. 26, 2000, now abandoned.

(51) Int. Cl.[7] ..... A63B 55/04

(52) U.S. Cl. ..... 206/315.6; 206/315.3; 211/70.2

(58) Field of Search ..... 206/315.3, 315.6; 211/70.2; D3/320, 255

(56) References Cited

U.S. PATENT DOCUMENTS

| | | | | | |
|---|---|---|---|---|---|
| 2,879,819 | A | * | 3/1959 | Turnbull | 206/315.2 |
| 3,554,255 | A | * | 1/1971 | Mangan | 206/315.3 |
| 3,980,115 | A | | 9/1976 | Longo | |
| 3,996,983 | A | | 12/1976 | Isnardi | |
| 4,172,484 | A | | 10/1979 | Henning | |
| 4,194,547 | A | * | 3/1980 | Sidor et al. | 206/315.6 |
| 4,332,283 | A | | 6/1982 | Rader | |
| 5,135,107 | A | * | 8/1992 | Ingraham | 206/315.6 |
| 5,267,660 | A | * | 12/1993 | Kwon | 206/315.6 X |
| 5,392,907 | A | | 2/1995 | Blanchard et al. | |
| 5,458,240 | A | * | 10/1995 | Rich et al. | 206/315.3 |
| 5,720,388 | A | | 2/1998 | King et al. | |
| 5,772,024 | A | * | 6/1998 | Lueders | 206/215.3 X |
| 5,816,396 | A | * | 10/1998 | Shin | 206/315.3 |
| 5,853,086 | A | * | 12/1998 | Chang | 206/315.3 X |
| 6,209,721 | B1 | * | 4/2001 | Sharpe et al. | 206/215.6 |

FOREIGN PATENT DOCUMENTS

| | | | | |
|---|---|---|---|---|
| JP | 7-47153 | * | 7/1995 | A63B/55/00 |
| WO | WO96 14111 | * | 5/1996 | A63B/55/00 |

* cited by examiner

*Primary Examiner*—Tri Mai
(74) *Attorney, Agent, or Firm*—Cislo & Thomas LLP

(57) ABSTRACT

A golf bag having a club-separating staggered honeycomb-like cell structure and a method for manufacturing is disclosed. The golf bag includes a plurality of individual hollow fabric-lined plastic or soft fabric tubes coupled to a top opening or collar, and confined or anchored by a bottom or base. The full-length tubing separates and protects the shafts of the golf clubs and prevent them from becoming entangled. The collar comprises a plurality of openings arranged in a honeycomb cell configuration. The cell openings are elongated to maximize the separation between club heads and also allow easy access for club retrieval and replacement. The base as configured keeps the lower end of the tubes in line with cell openings at the other end of the golf bag. The method of manufacturing consists of shaping, positioning and attaching a plurality of tubing to the collar and the base to form the honeycomb cell structure.

16 Claims, 16 Drawing Sheets

14

14

14

GOLF BAG WITH HONEYCOMB CELL STRUCTURE

CROSS-REFERENCES TO RELATED APPLICATIONS

This patent application is a continuation-in-part to U.S. patent application Ser. No. 09/603,803 filed Jun. 26, 2000 for a GOLF BAG WITH HONEYCOMB CELL STRUCTURE, now abandoned, but subject to a petition to revive.

BACKGROUND OF THE INVENTION

1. Field of the Invention

This invention relates to golf bags and more particularly to golf bags with a plurality of dividers to keep golf clubs separated and prevent contact with other clubs.

2. Description of the Prior Art

Conventional golf bags have variously sized and shaped dividers at the top opening of the bag for the purpose of separating and dividing the golf clubs. Typically these dividers tend to divide only the entrance to the bag, allowing the club shafts within the bag to move about freely and become entangled with and contact each other. Once the clubs are entangled they become difficult to remove, and can cause damage to the club shaft and/or grip. Golf club shafts made from expensive lightweight composite are especially susceptible to damage by contacting other clubs.

Prior golf bags have three or four openings with full-length dividers. These numbers of openings are not enough, requiring at least three clubs per opening, which can still allow club shafts to entangle and become damaged. For example, U.S. Pat. No. 5,431,278 to Gretz, and entitled "Golf Bag with Adhesively Secured Divider Panels and Adhesively Secured Tubular Body," discloses a golf bag with divider panels adhesively secured within the cylindrical tubular body. This golf bag has only five compartments for a full set of fourteen clubs to share.

Yet, other golf bags have attempted individual compartments for each golf club. For example, U.S. Pat. No. 5,573,112 to Kim, and entitled "Golf Bag with Inserted Symmetrical Full Length Divider," discloses a two-tube construction with a series of inner portions made up of soft cloth interior sewn along the axial length of the more rigid tubular exterior. U.S. Pat. No. 5,915,320 to Wang, and entitled "Method of Forming a Golf Bag Insert," discloses a method for constructing a soft fabric insert for golf bags with partitions for golf clubs. These cloth dividers are difficult to fabricate and are not easily shaped to be space efficient.

Other golf bags separate the individual clubs using a series of elongated tubular members, which span the entire length of the bag. A shortcoming of this type of divider system is that the openings for the individual clubs are relatively small and too close together. It requires precise alignment of the grip end of the club before a club may be inserted back into the bags. If the tubular members are not secured to the golf bag, they can be pulled out unintentionally when removing golf clubs.

U.S. Pat. No. 4,332,283 to Rader, and entitled "Device for Supporting and Protecting Golf Clubs," and U.S. Pat. No. 5,720,388 to King, and entitled "Polygonally Shaped Golf Club Shaft Protector," disclosed a plurality of elongated protective tubes of plastic material and the like. A major drawback of plastic tubes is that they can be easily kinked and leave a permanent crease, which can rub against club shafts during transport and induce wear to the shafts, especially graphite shafts. Furthermore, the wear problem can occur at any point where there is repeated rubbing with plastic, especially at the club entry end of the tubes.

Other general shortcomings of golf bag structures and in particular golf bag dividers with the openings too close to each other are that they permit the iron heads of the shorter clubs to impact the hosel and shaft areas of the clubs in the adjacent row, thereby inflicting damage to them. This is particularly critical with the advent of the more sophisticated graphite shafts where the shaft coating is made of materials that can be easily damaged. Constant wear caused by the other golf clubs often results in damage to the shafts or to the paint coating, thereby producing an unsightly and distracting area on the shaft visible to a golfer using the club.

Today's golfer needs a lightweight bag which offers the maximum protection of individual clubs. A golf bag with a partitioning system, which can prevent club entanglement, provides ease of locating, retrieving and replacing golf clubs, and does not significantly increase the weight of the golf bag is desirable.

The present invention provides a golf bag assembly which overcomes the foregoing problems. As discussed in detail below, the golf clubs are individually contained and protected in lightweight fabric-lined plastic or fabric tubes. These tubes are encapsulated within the apertures in the upper collar. The apertures are spaced to maintain the clubs at a prescribed arrangement within the bag resulting in a club-separating system which prevents club entanglement, minimizes club head engagement, provides ease of locating, retrieving and replacing golf clubs, and is space-efficient and does not significantly increase the weight of the golf bag.

SUMMARY OF THE INVENTION

The present invention relates to a golf bag with individual club-separating compartments. The present invention encompasses a golf bag with a club-separating honeycomb-like cell structure, i.e., resembling a mass of cells built by bees to store their honey. This structure may be constructed utilizing thin-wall semi-rigid plastic round tubing lined with a soft fabric material to create individual chambers for each club. The tubing separates and protects the shafts of the golf clubs from contacting one another. The distal ends of the tubing are coupled to a collar consisting of multiple openings arranged in a honeycomb-like or staggered pattern. The openings in the collar are of the shapes of elongated diamonds, hexagons, octagons, ovals or the like. The opposite ends of the tubing are confined by the base of the golf bag. The resulting structure of the present invention enables a space efficient and orderly arrangement of the golf clubs.

The method for constructing the golf bag with the club separating honeycomb compartments provides for a simple and effective use of readily available thin-wall round tubing lined with a soft fabric arranged into a space efficient configuration. The utilization of thin-wall tubing with ends flexible enough to be stretched to the shape of individual cavities of the collar allows the coupling of the tubing to the collar.

Alternatively, lightweight fabric tubes create individual cells for each club, to separate and protect the shafts of the golf clubs from contacting one another. The receiving ends of tubes are encapsulated within the openings of the collar, which consist of multiple hexagonal- or octagonal-shaped openings arranged in a predetermined pattern. The opposite ends of these tubes are confined by the slotted base plate, which is held spaced apart from the collar by support rods. This cell structure of collar, support rods, fabric tubes and slotted base plate make up the internal structure of the golf bag.

OBJECTS OF THE INVENTION

It is an object of the present invention to provide a golf bag to keep separate individual golf club shafts and protect them from damage when positioned therein.

A further object of this invention is to provide a golf bag with clubs arranged in a space-efficient manner to allow for ease of club insertion and removal.

A further object of this invention is to provide a lightweight golf bag with individual club-separating chambers.

A further object of this invention is to provide arranged golf club-separating tubing in a honeycomb-like or staggered configuration.

A further object of this invention is to provide coupling of round tubing to shaped receptacles such as a diamond, a hexagon or an oval.

It is a still further object of this invention to provide a method of coupling soft fabric tubes to an upper collar and lower base plate to form a cell structure.

These and other objects and advantages of the present invention will be apparent from a review of the following specification and accompanying drawings.

LIST OF REFERENCE NUMERALS UTILIZED IN THE DRAWINGS

| | |
|---|---|
| (10) | golf bag |
| (12) | housing/outer shell |
| (13) | shoulder strap |
| (14) | collar |
| (15) | base |
| (16) | tubing |
| (16A) | distal end |
| (16B) | fabric liner |
| (18) | tee |
| (19) | tube guides |
| (20) | stand |
| (21) | driver |
| (22, 23) | woods |
| (24–30) | irons |
| (31–33) | wedges |
| (34) | putter |
| (40) | honeycomb-like cell structure |
| (41) | hexagonal cell opening |
| (42) | diamond shape cell opening |
| (43) | oval shape cell opening |
| (50) | cell opening |
| (51) | tee holder |
| (52) | top row cell opening |
| (53) | second row cell opening |
| (54) | third row cell opening |
| (55) | bottom row cell opening |
| (56) | protruding wall around the cell opening |
| (60) | virtual cells |
| (61) | adjacent tubing |
| (62) | virtual cells |
| (110) | second embodiment |
| (115) | base |
| (116) | fabric tubing |
| (117) | slots |
| (118) | clips |
| (119) | slotted base plate |
| (120) | grommets |
| (122) | felt liner |
| (123) | ledge |
| (124) | three support rods |

DETAIL DESCRIPTION OF THE INVENTION

The detailed description set forth below in connection with the appended drawings is intended as a description of presently-preferred embodiments of the invention and is not intended to represent the only forms in which the present invention may be constructed and/or utilized. The description sets forth the structure and the sequence of steps for constructing and operating the invention in connection with the illustrated embodiments. It is to be understood, however, that the same or equivalent structure and steps may be accomplished by different embodiments that are also intended to be encompassed within the spirit and scope of the invention.

Figure 1:
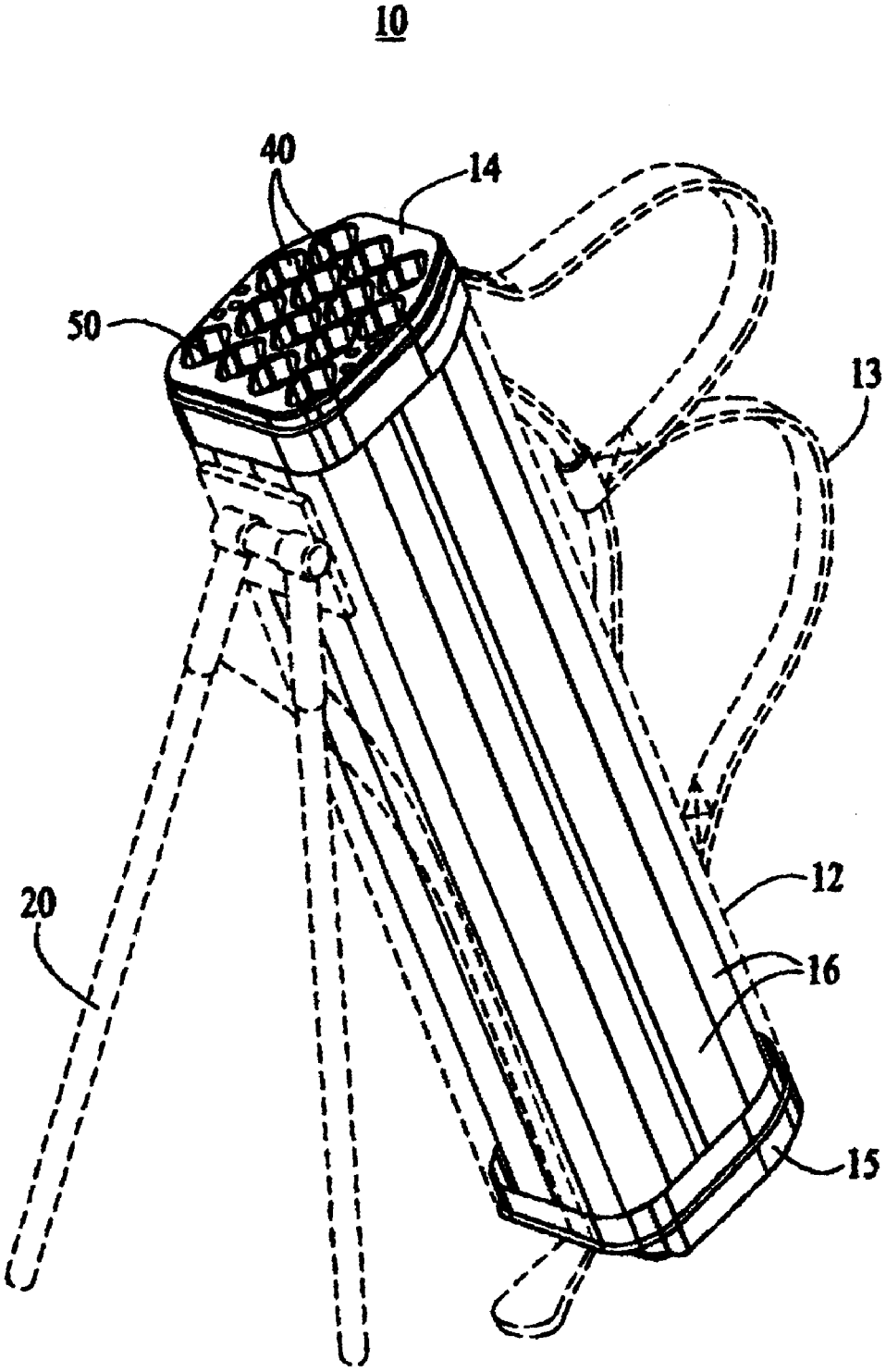
FIG. 1 depicts a perspective view of the preferred embodiment within a see-through shell of a golf bag.

Referring to FIG. 1, in a preferred embodiment, the golf bag 10 with individual club separating compartments includes a collar 14, tubular cells 16, and a base 15 disposed within the housing of outer shell 12 of the golf bag 10.

The particular golf bag 10 illustrated is a lightweight walking bag. It includes a dual carrying strap 13 and self-retracting stands 20.

Figure 2:
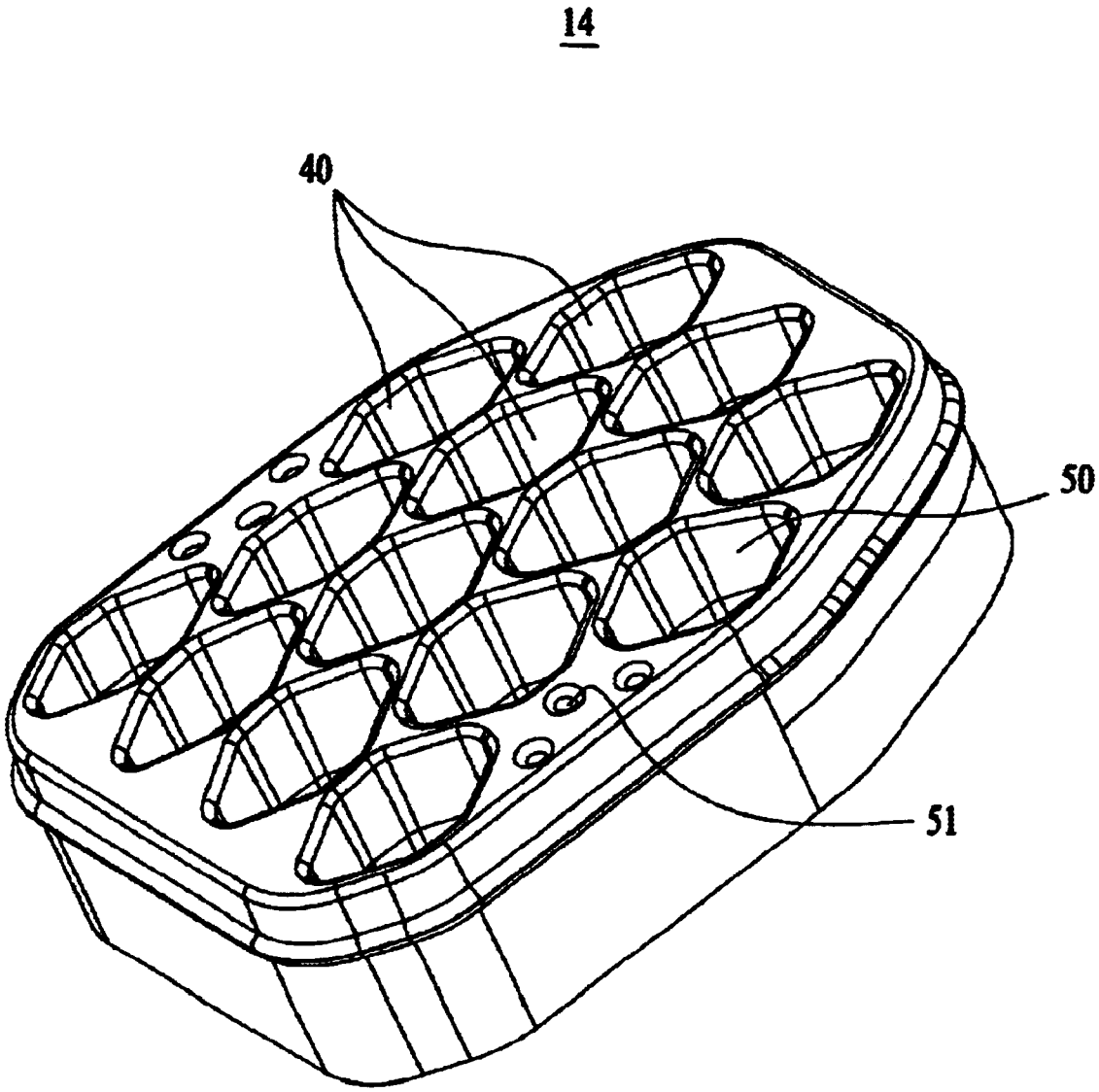
FIG. 2 depicts a perspective view of the collar of the golf bag.

Referring to FIG. 2, the collar 14 has individual cell openings 50 to receive the grip end of the golf clubs. The cell openings 50 are arranged in a honeycomb-like or staggered configuration 40, as shown. There are a total of fourteen (14) openings to accommodate a full set of golf clubs. Other embodiments of the present invention, however, could have more or less openings to accommodate other items such as an umbrella and/or ball retriever. The six (6) smaller openings are tee holders 51.

Figure 3:
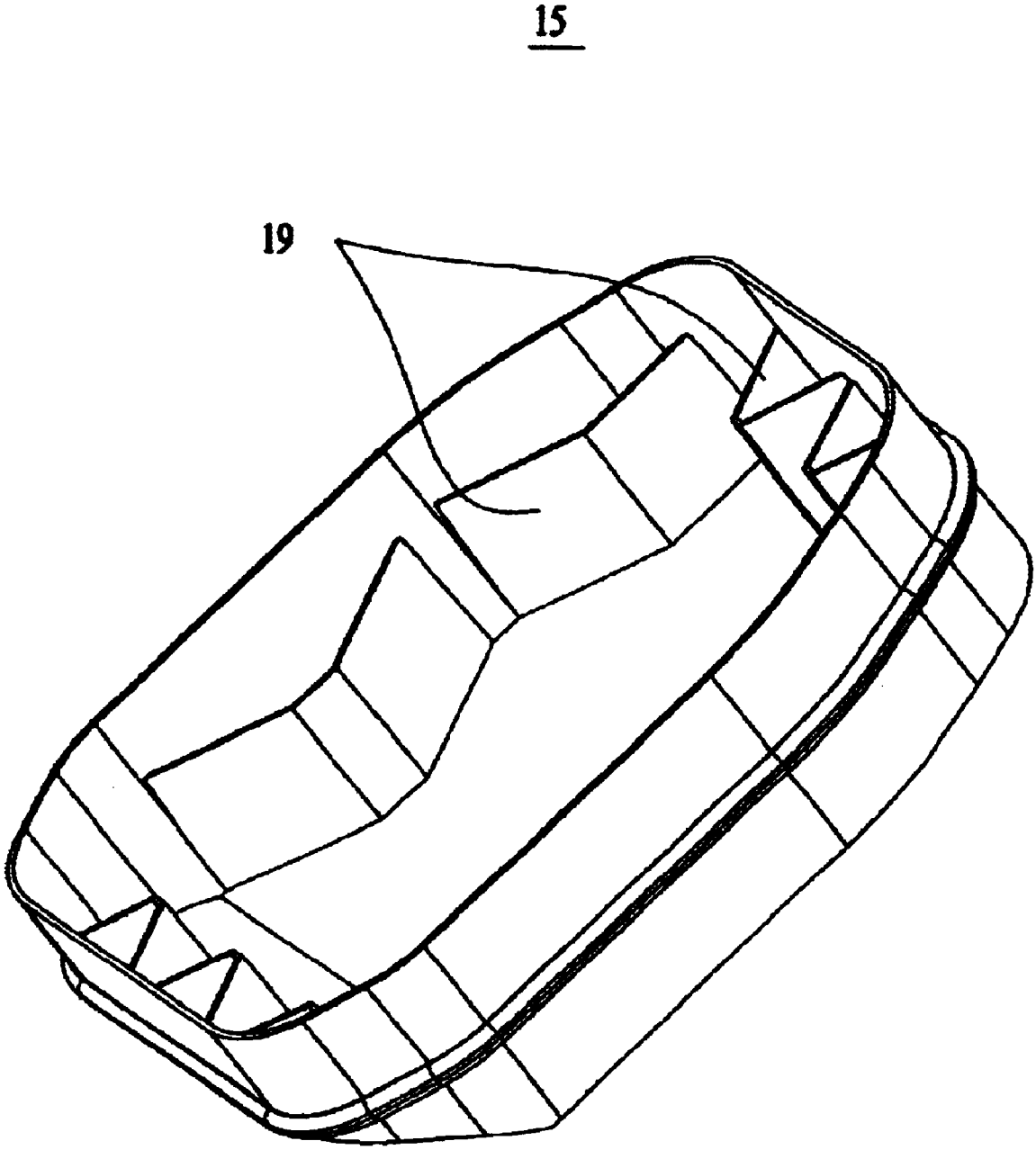
FIG. 3 depicts a perspective view of the base of the golf bag.

Referring to FIG. 3, the base 15 includes tube guides 19 to keep the lower end of the tubular cells 16 from shifting during normal use.

Figure 4:
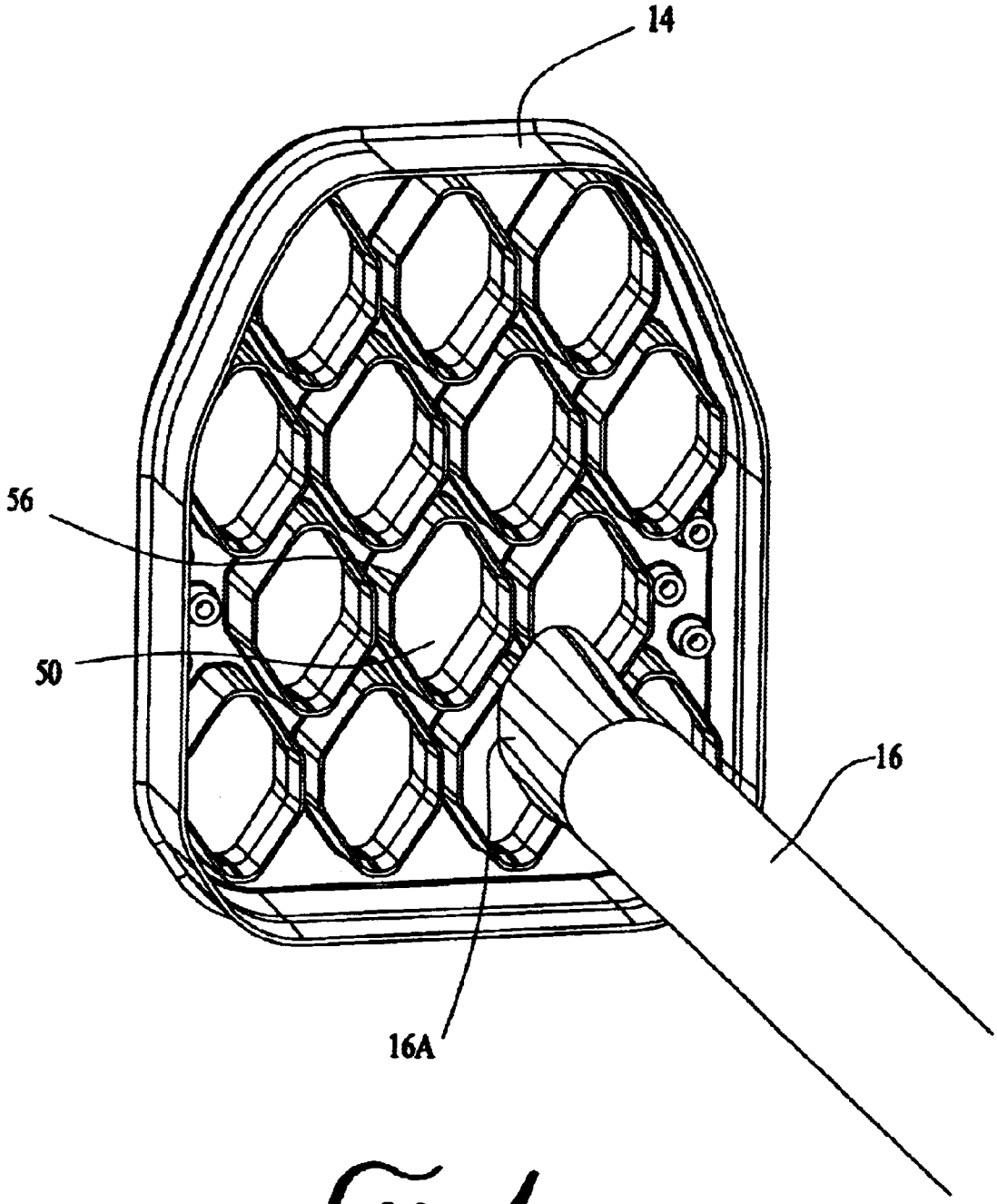
FIG. 4 depicts a perspective view of the bottom side of the collar and one of the tubing with its end stretched for coupling to the cell opening on the collar.

FIG. 4 illustrates the preferred method of manufacturing the present invention. The distal end 16A of the tubing 16 is stretched to match the shape of the opening 50 on the backside of the collar 14. The distal end 16A is then slipped over the protruding wall 56 around the opening 50 on the backside of the collar 14, coupling the tubing 16 to the collar 14. The fabric liner 16B is shown in a cutaway view of tubing 16.

Figure 5:
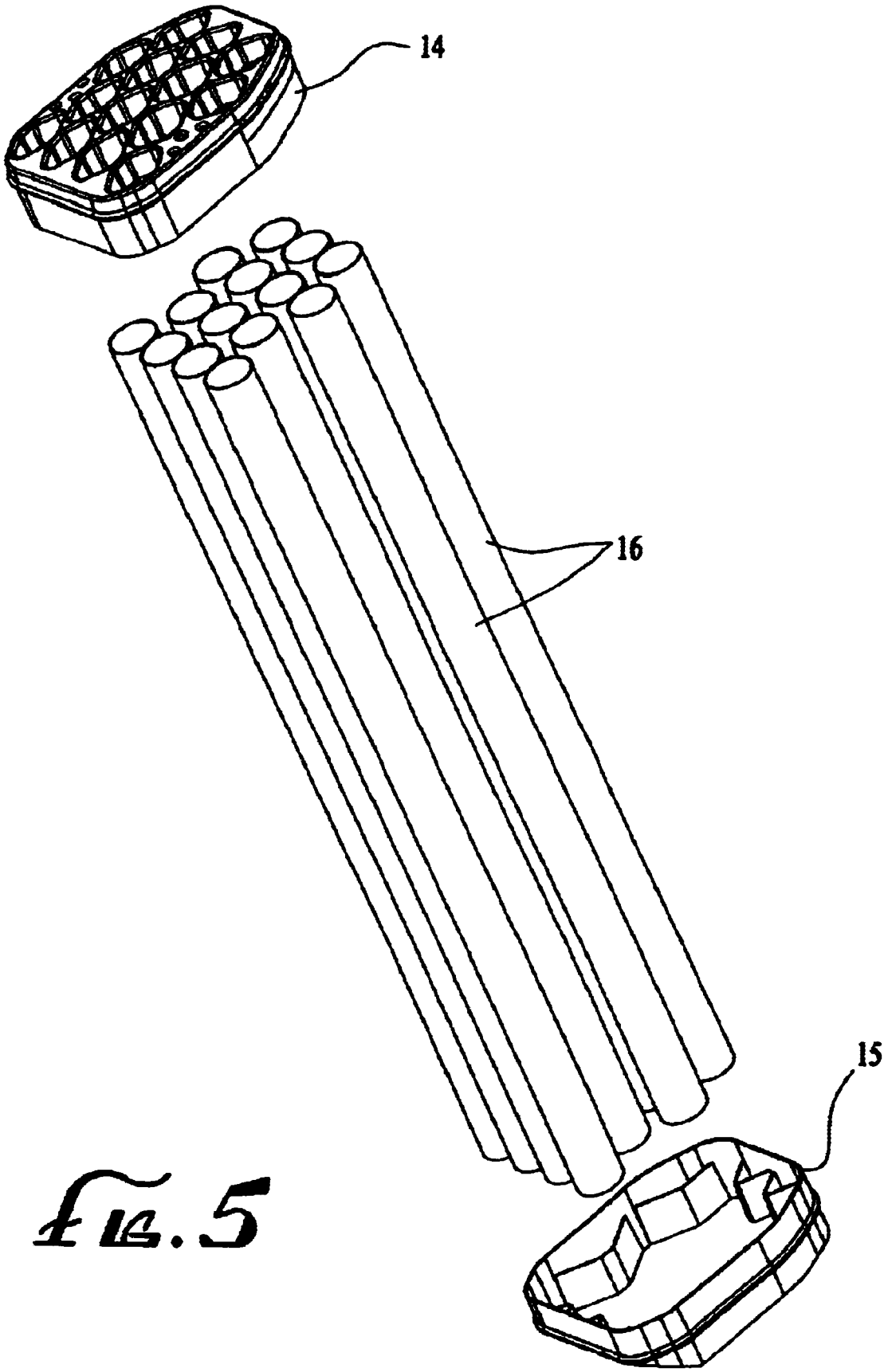
FIG. 5 depicts an exploded and perspective view of the collar, the tubing, and the base in alignment for assembly.
Figure 5A:
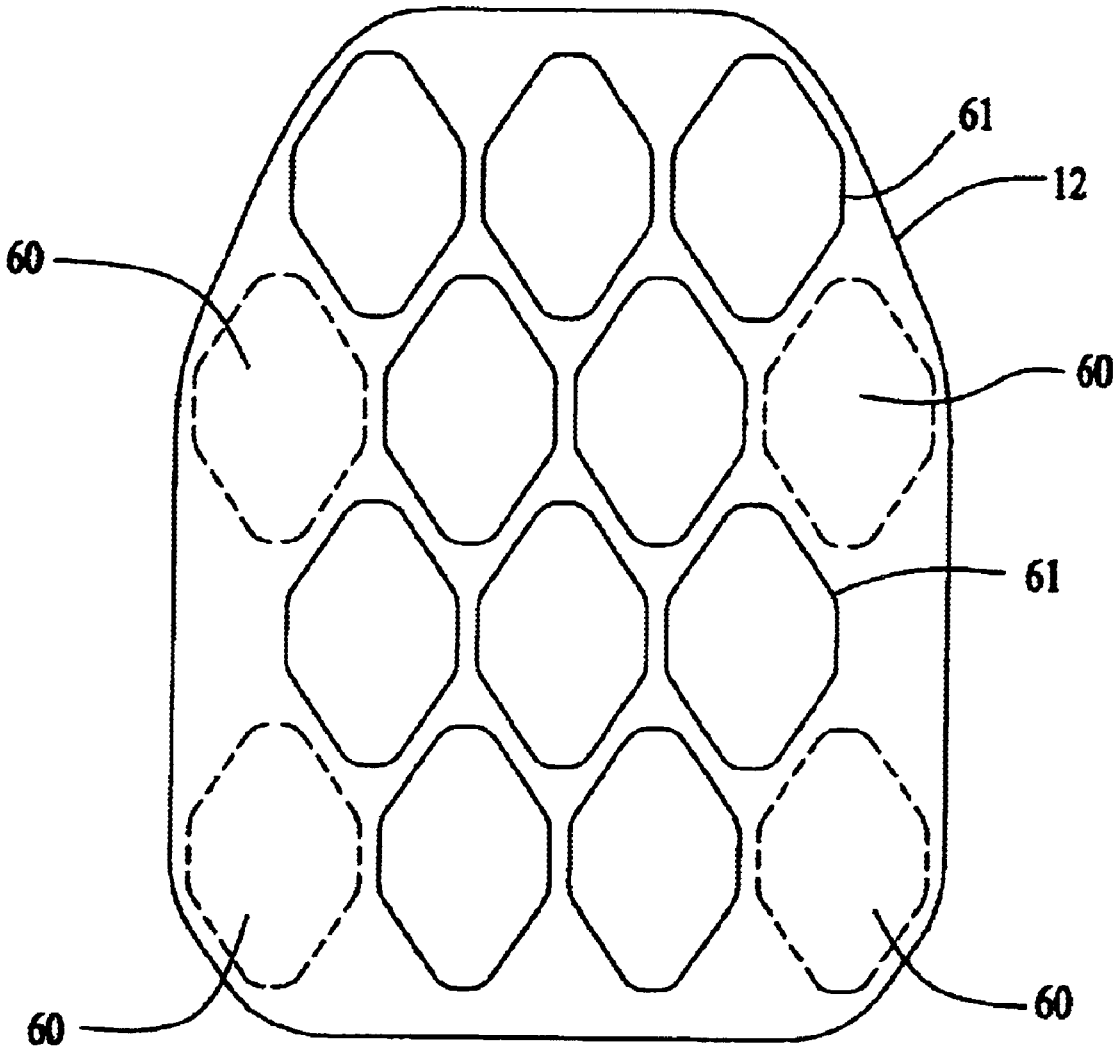
FIG. 5A–5B depict cross-sectional views of the honeycomb-like or staggered cell structure.
Figure 5B:
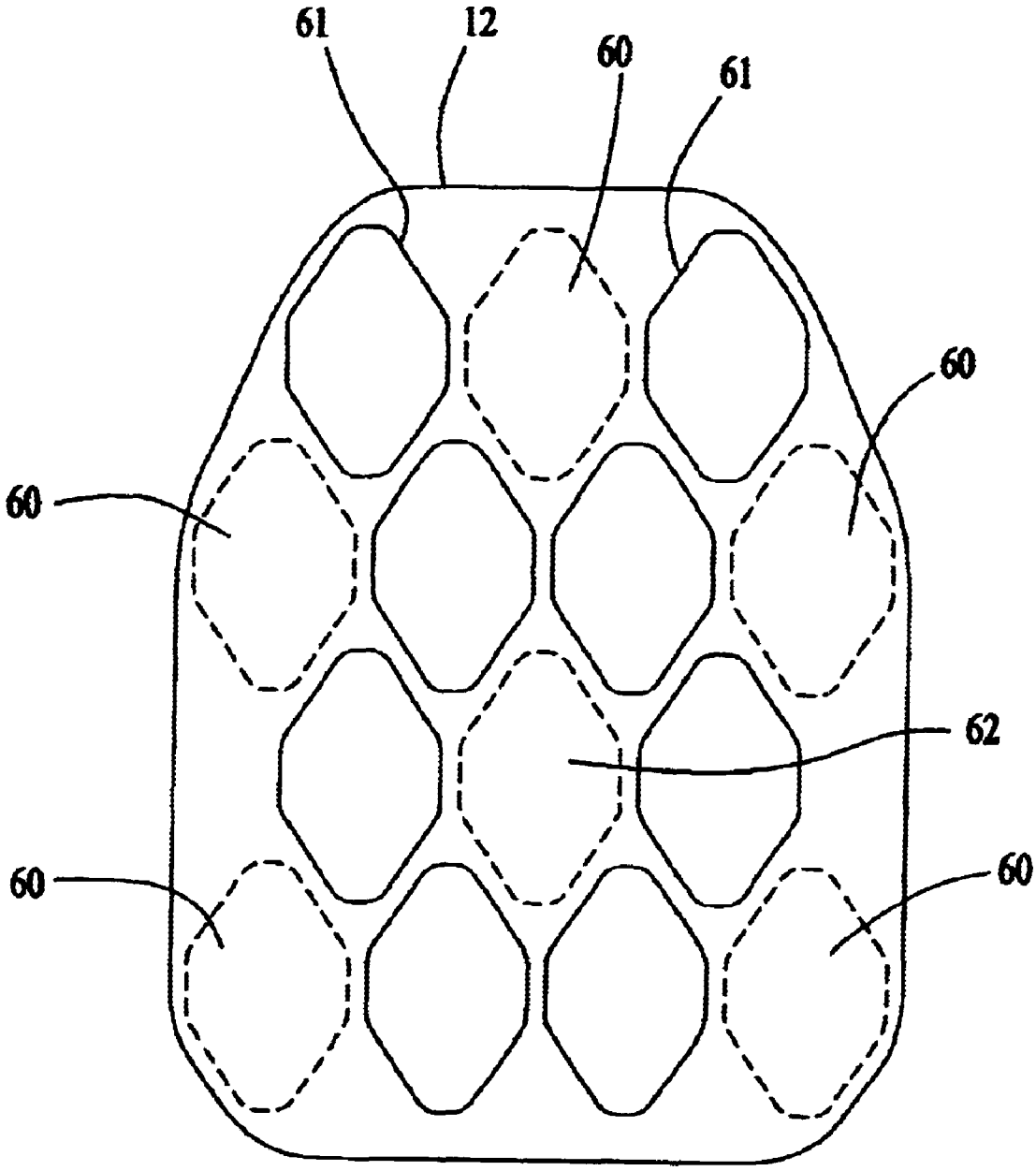

Referring to FIG. 5, individual tubing 16 is aligned with openings in the collar 14 on one end and aligned with the tube guides 19 of the base 15 on the other end, and all fourteen tubes are shown. To reduce overall carrying weight, some of the tubing can be eliminated. FIG. 5A illustrates that ten (10) actual tubing are used to create fourteen (14) individual pockets. Four (4) virtual cells 60 can be created by using the walls of adjacent tubing 61 and the outer shell 12 of the golf bag. FIG. 5B illustrates how eight (8) actual tubing can be used to create fourteen individual pockets. The virtual cells 62 are created by the walls of adjacent tubing 61, and the five other virtual cells 60 are created by the walls of adjacent tubing 61 and the outer shell 12 of the golf bag 10. Other embodiments of the present invention could also be used to eliminate some of the tubing, making the golf bag lighter.

Figure 6:
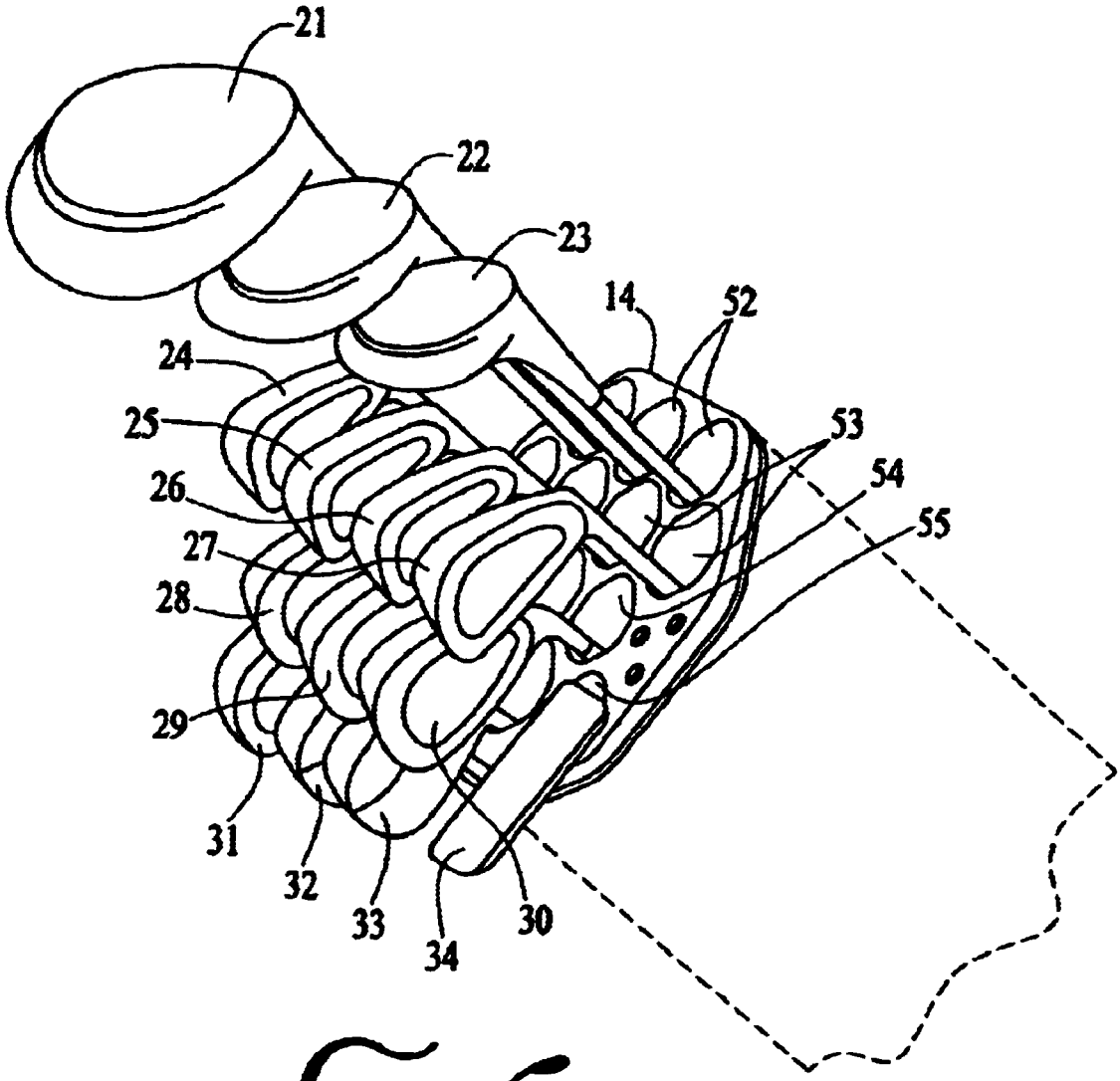
FIG. 6 depicts a perspective view of the preferred embodiment with golf clubs inserted.
Figure 6A:
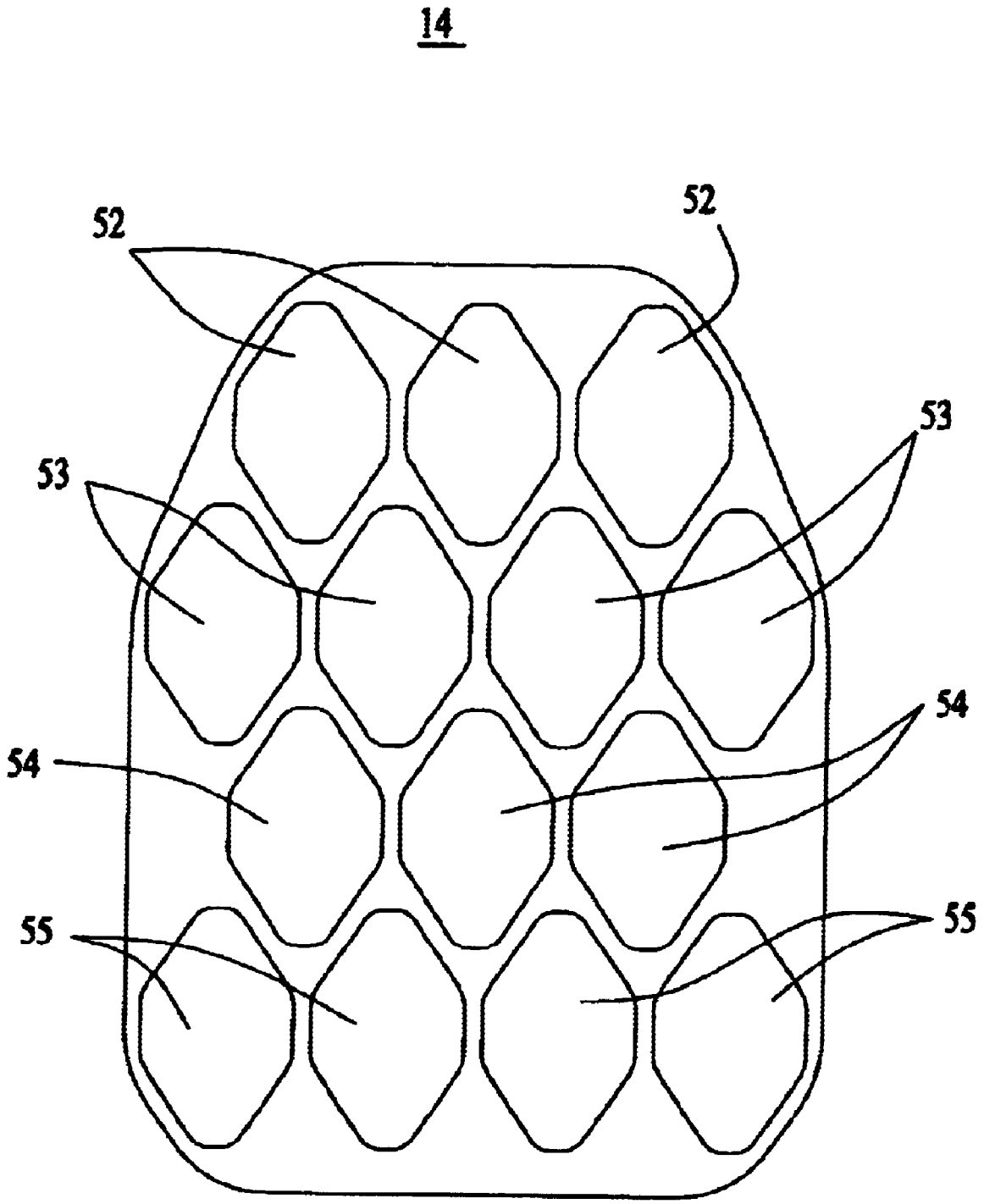
FIG. 6A depicts a top view of the collar of the golf bag.

Referring to FIG. 6, fourteen clubs are inserted into the openings in the collar 14 of the golf bag 10. The longer clubs, usually the driver 21 and fairway woods 22, 23 are inserted into the top row 52 cell openings, also shown in FIG. 6A. The long and middle irons 24, 25, 26, 27 are inserted into the second row 53 cell openings, also shown in FIG. 6A. The short irons 28, 29, 30 are inserted into the third row 54 cell openings, also shown in FIG. 6A. The wedges 31, 32, 33 and the putter 34 are inserted into the bottom row 55 cell openings, also shown in FIG. 6A. The elongated cell openings increase the distance between rows of clubs. The staggered honeycomb-like cells allow club heads to nestle between the club heads in the lower adjacent row of clubs. For example, club 29 in the middle of the third row 54 is nestled between clubs 32 and 33 in the bottom row 55, and club 26 in the second row 53 is nestled between clubs 29 and 30 in the third row 54. This elongated honeycomb configuration allows the clubs to obtain maximum separation. This configuration also organizes the clubs in a neatly and orderly arrangement, facilitating ease of identifying, retrieving and removal of clubs.

Figure 7A:
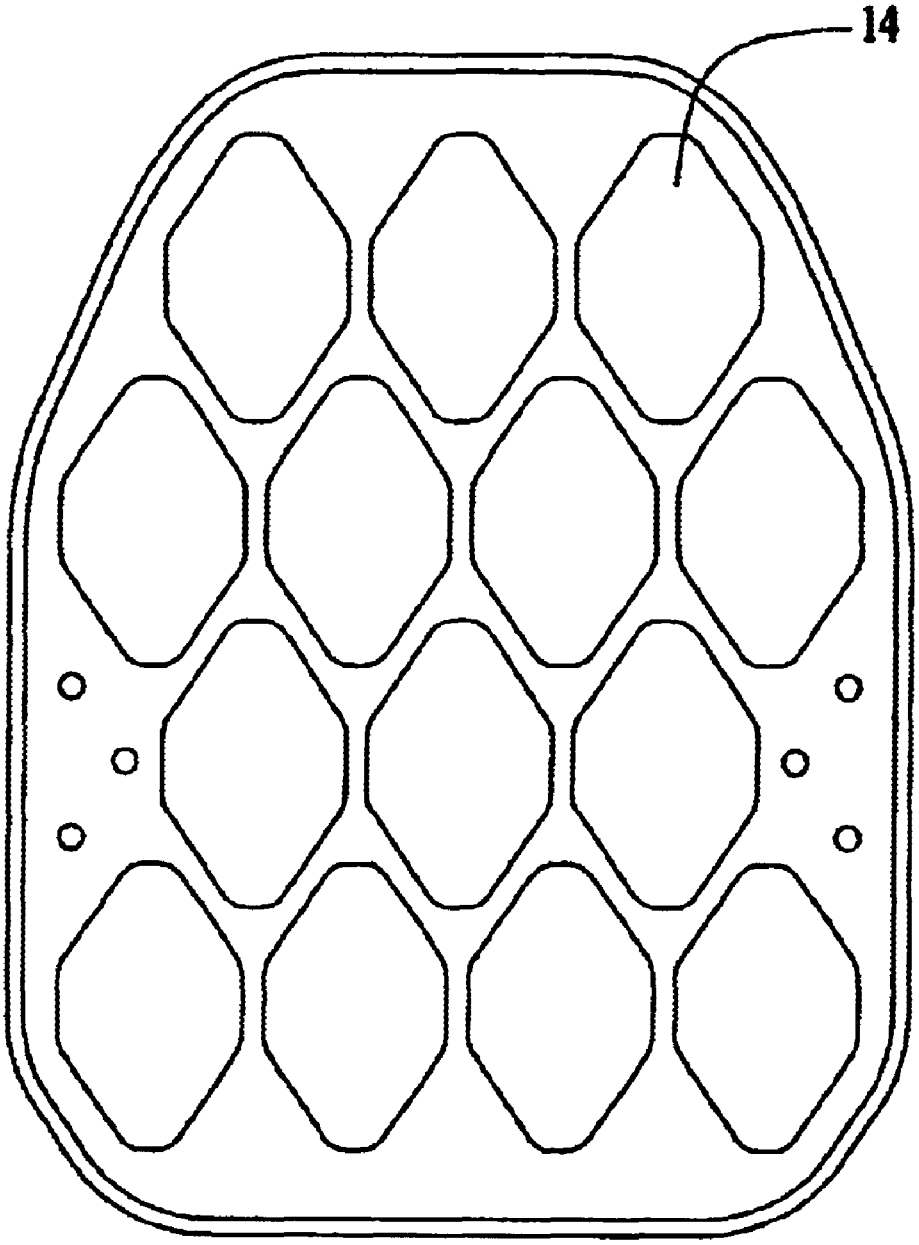
FIG. 7A–7C are top views of various shapes of cell openings on the collar.

FIG. 7A illustrates an elongated hexagonal 41 cell openings arranged in a staggered honeycomb-like configuration. The corners of the hexagons are rounded. The elongated cell configuration created maximum cell openings and club-to-club separation. The honeycomb structure also minimized the overall space required for all the clubs.

Figure 7B:
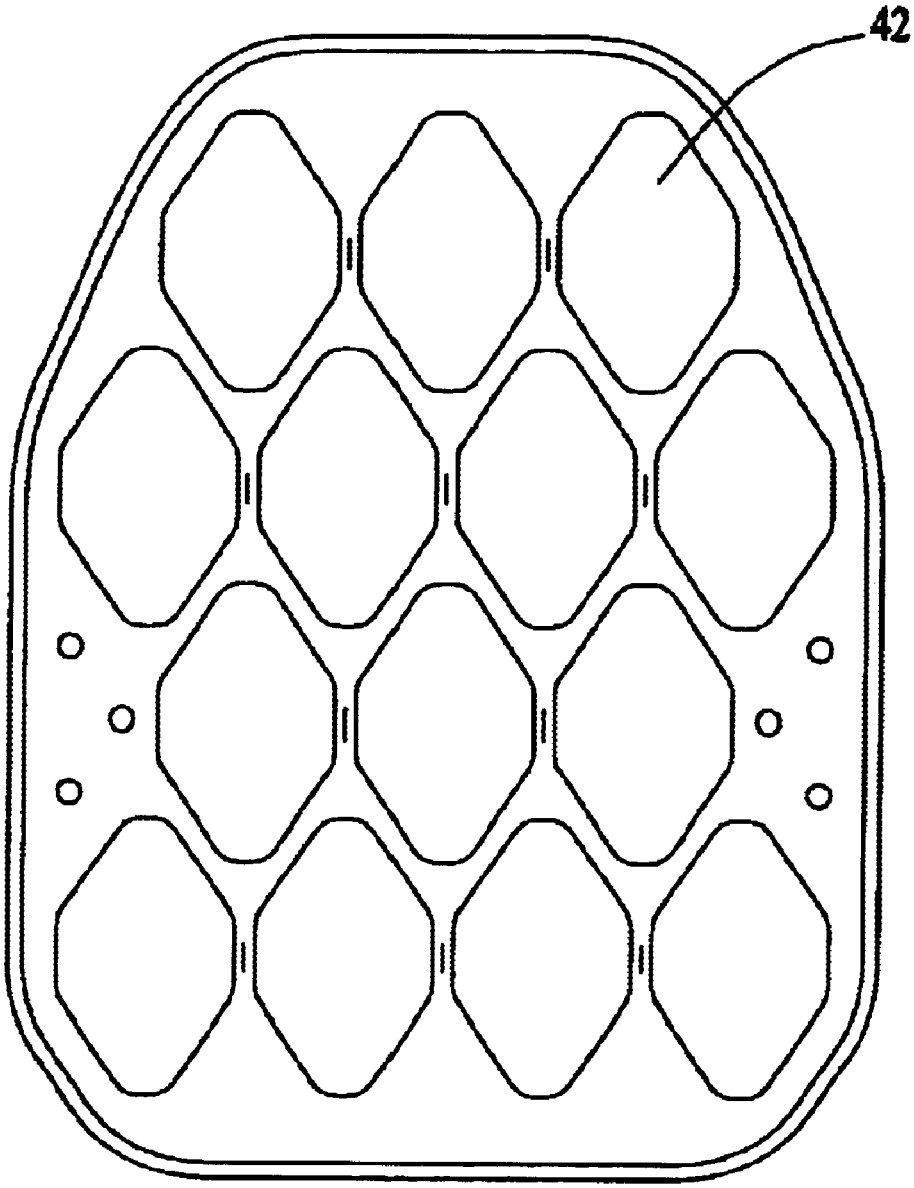

Other embodiments of the present invention could have diamond shape 42 cell openings as illustrated by FIG. 7B. The corners of the diamonds are rounded.

Figure 7C:
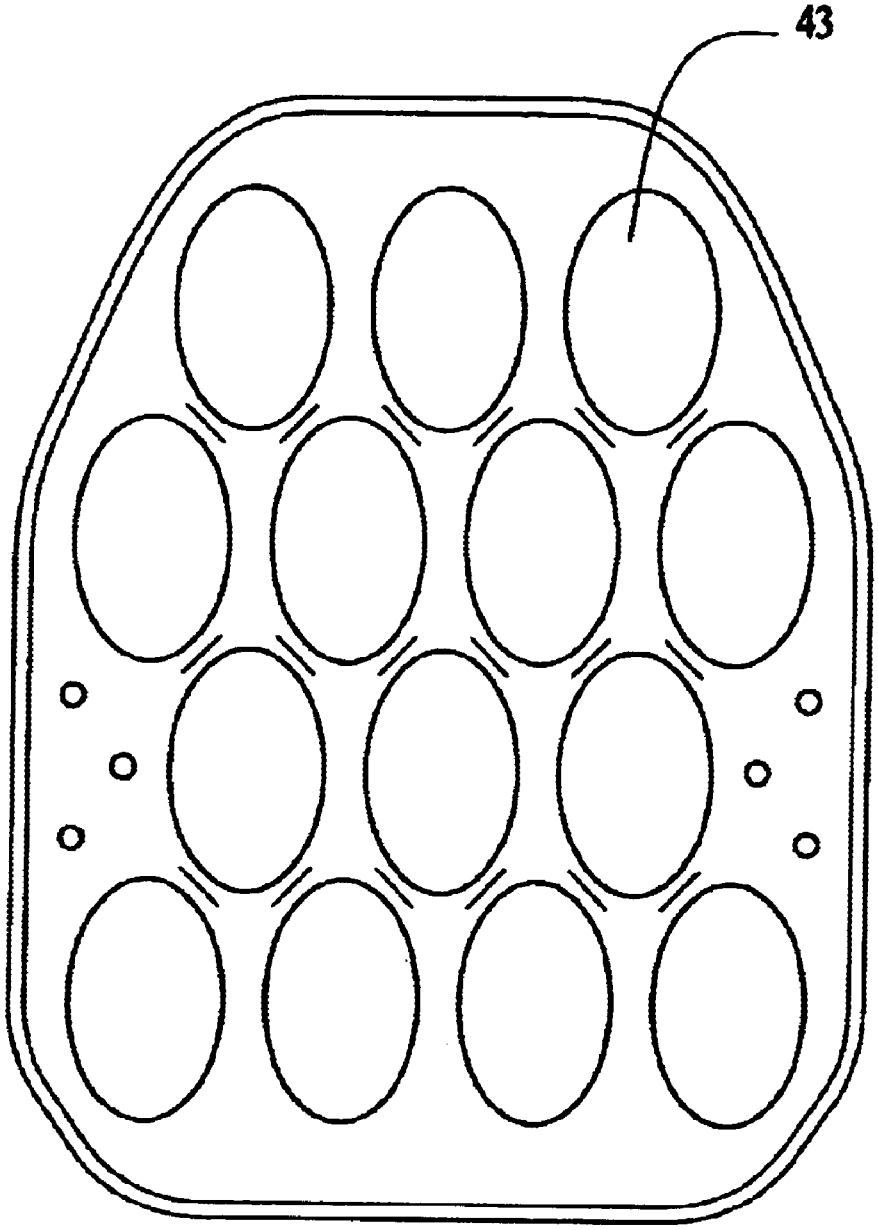

Yet other embodiments of the present invention could have oval shape 43 cell openings as illustrated by FIG. 7C. These elongated cell configurations all have common features of maximum cell openings and separation between clubs. The staggered honeycomb-like structure also provides maximum space efficiency.

Figure 8:
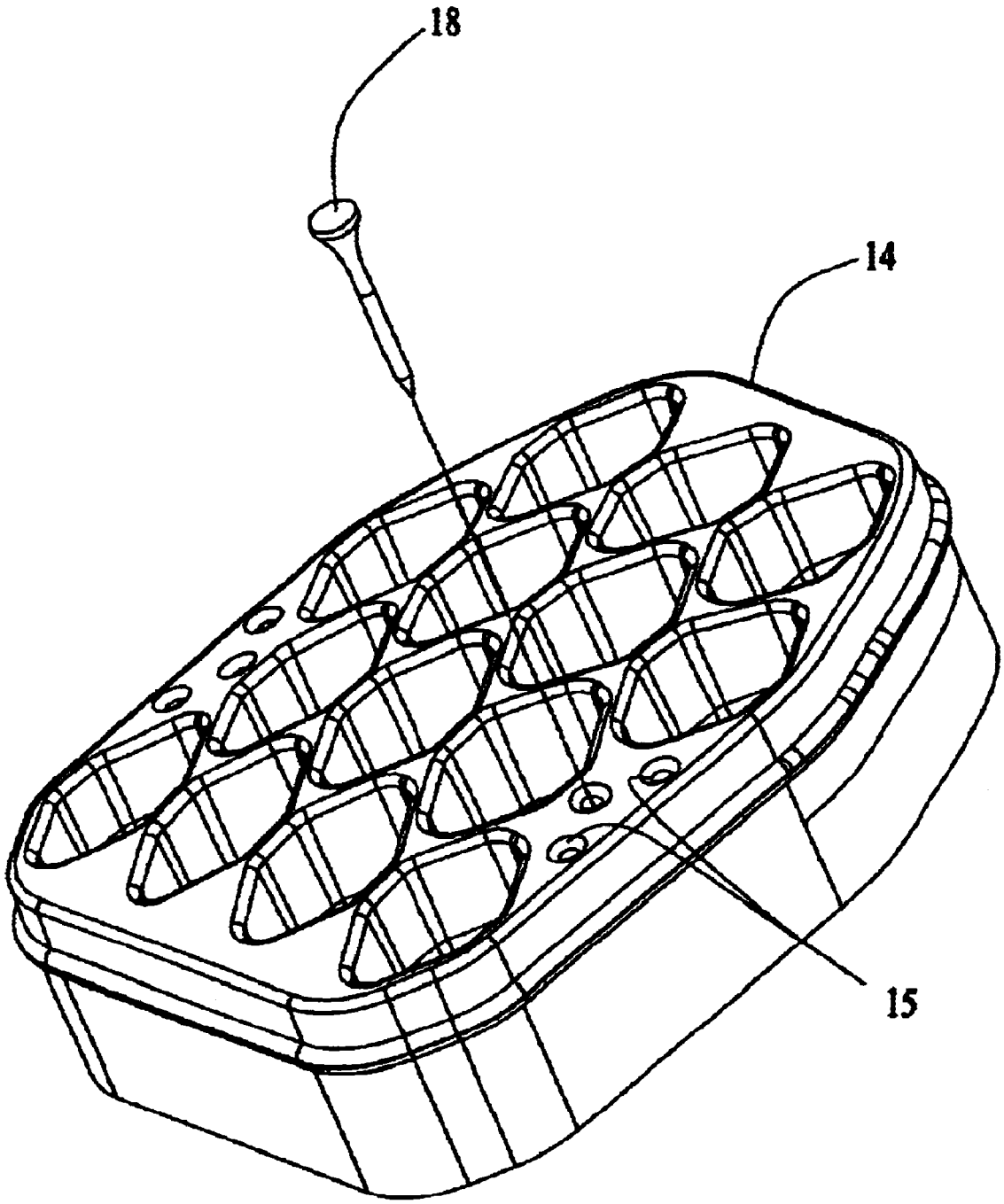
FIG. 8 depicts a perspective view of a tee in alignment with one of the tee holders on the collar.

FIG. 8 illustrates the preferred tees placement. A tee 18 is aligned with one of the tee holders 51 on the collar 14. The placement of the tees on the most visible part of the golf bag allows for easy retrieval.

Figure 9:
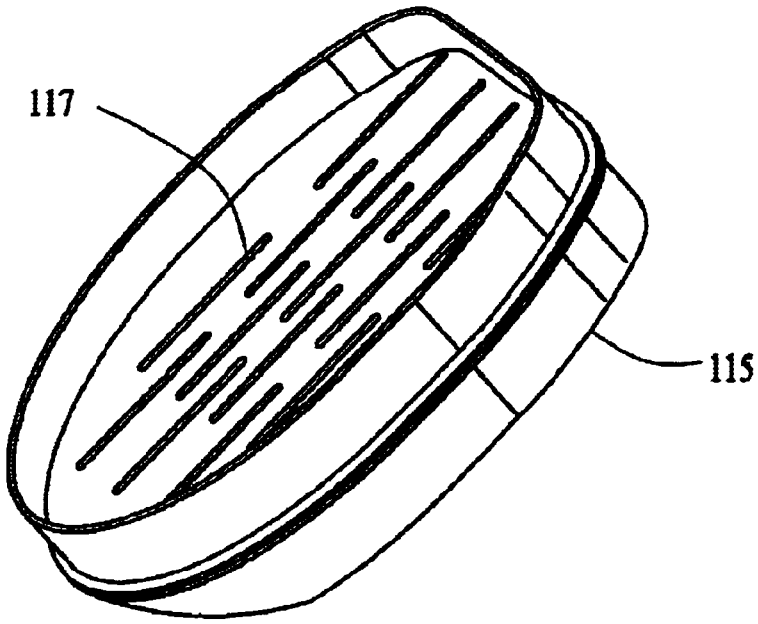
FIG. 9 depicts a perspective view of the collar and a slotted base plate spaced apart by three support rods, for a second preferred embodiment.
Figure 12:
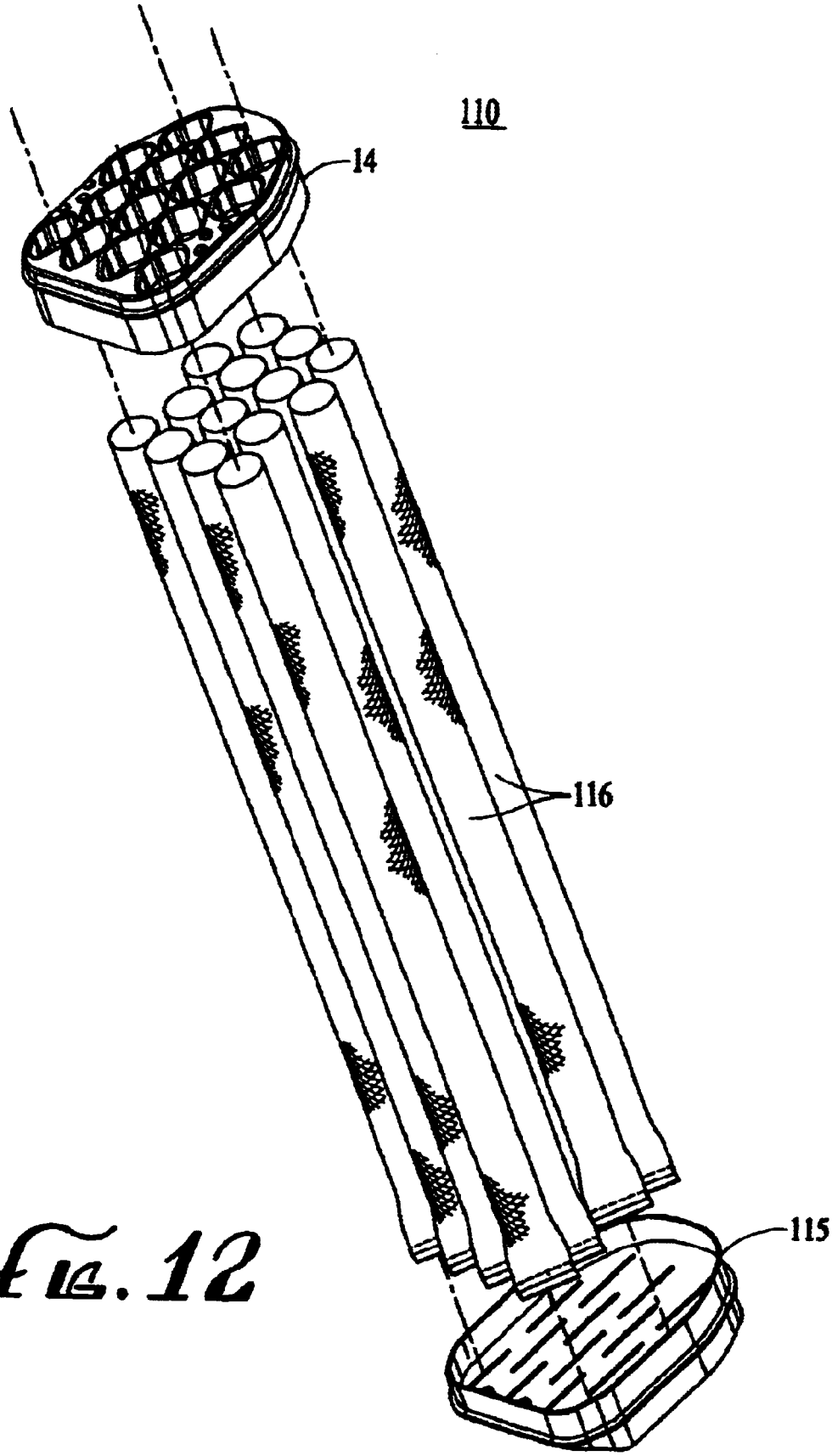
FIG. 12 depicts a perspective view of the assembly of the golf bag of the second embodiment.
Figure 7B:
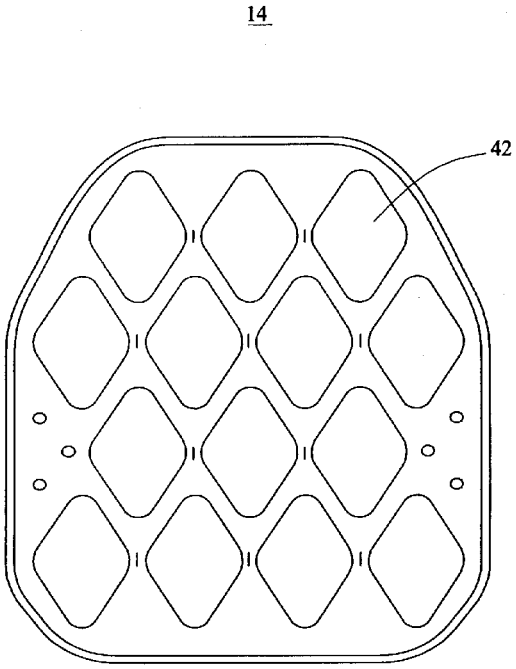

FIG. 12 illustrates the second embodiment 110, including generally the same basic collar 14, fabric tubing 116 and slotted base plate 119, held together by three support rods 124 and in alignment with a base 115. The outer shell of the fabric bag is omitted for illustration purposes. FIG. 9 further shows the internal structure of the golf bag without the fabric tubes 116. As can be seen, the collar 14 and the slotted base plate 119 of the base 115 are spaced apart by the three support rods 124. The near ends of the fabric tubes 116 are captive by the collar 14, and the far ends of the fabric tubes 116 are anchored by the slotted base plate 119.

Figure 10:
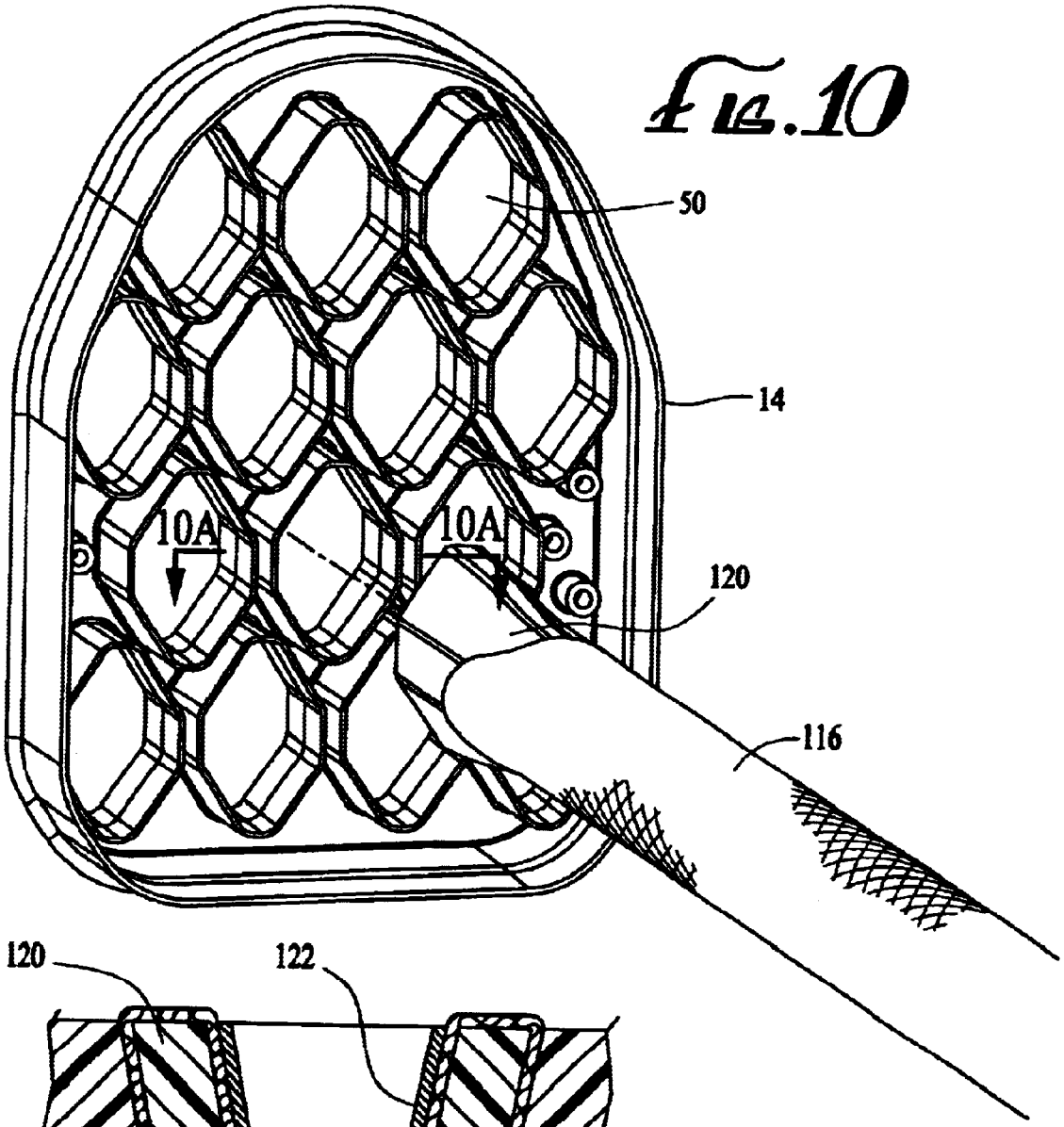
FIG. 10 depicts a perspective view of the collar and a fabric tube of the second embodiment.
Figure 10A:
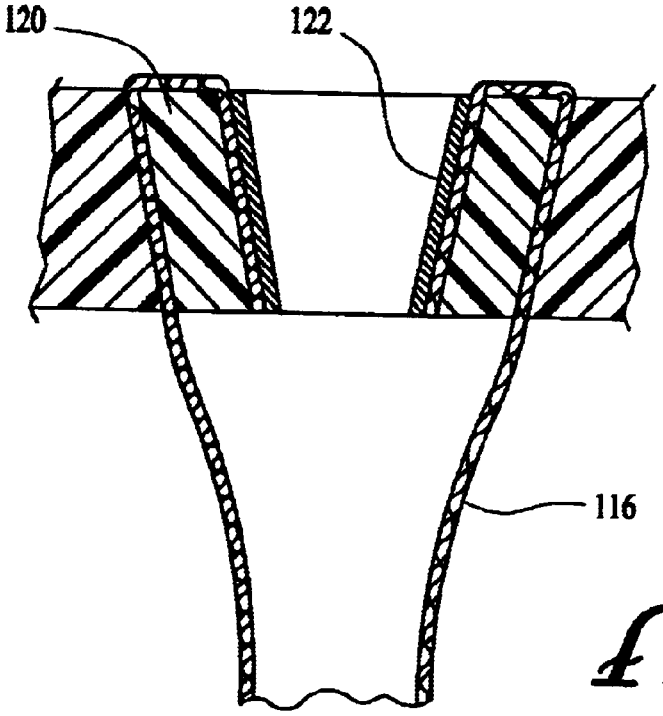
FIG. 10A depicts a section view of the attachment of the fabric tube to the collar.

As best shown in FIG. 10 and 10A, the near end of the fabric tubes 116 is seated in the collar 14 opening 50. The near end of the fabric tubes 116 is lined with a felt liner 122 and is attached to the collar 14 opening 50 utilizing grommets 120. The collar 14 openings 50 and grommets 120 are generally conically shaped, i.e. of decreasing cross-sections going into the bag. This facilitates nesting of the fabric tubes 116 with the attached felt liner 122, grommets 120, and collar 14 openings 50, one inside the other, wedged into the conically-shaped openings and resting against the ledge 123 at the bottom of the collar 14 opening 50, for securing of the near end of the fabric tubes 116 to the collar 14.

Figure 11:
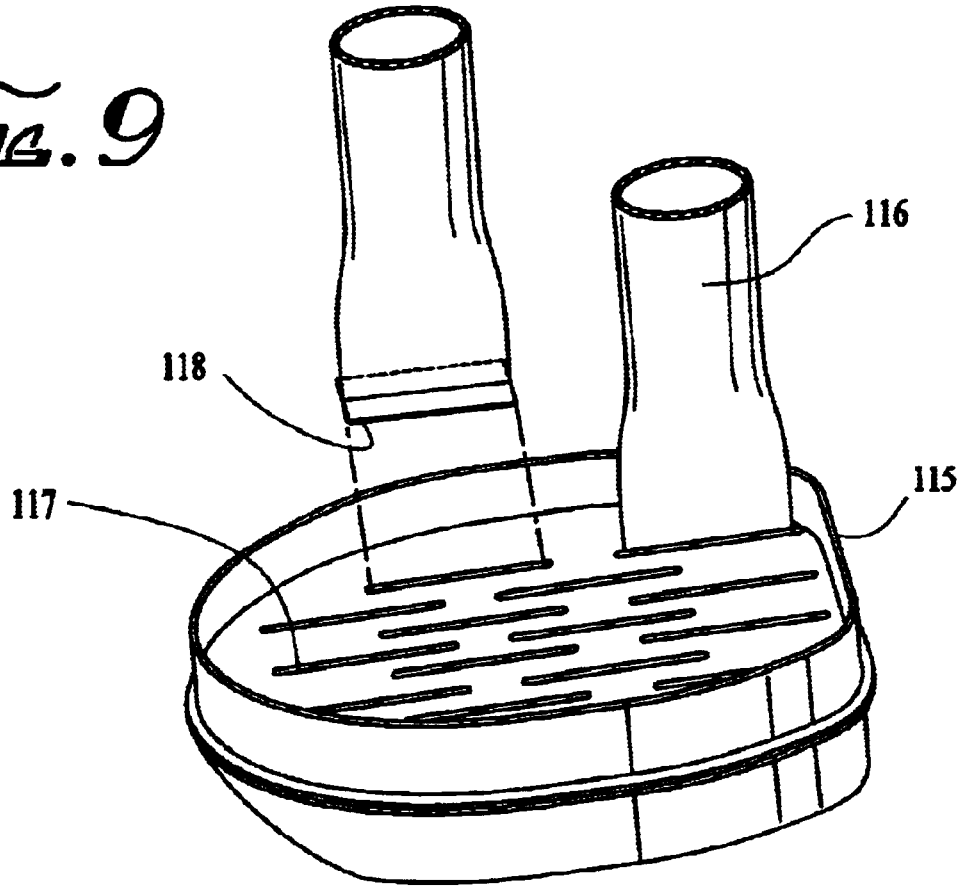
FIG. 11 depicts a perspective view of the base, slotted base plate and fabric tubes in alignment with the base of the second embodiment.

FIG. 11 shows the attachment of the far end of the fabric tubes 116 to the slotted base plate 119 of the base 115. The far end of each of the fourteen (14) fabric tubes 116 includes a rectangular-shaped clip 118. The slotted base plate 119 includes fourteen (14) corresponding slots 117 sized to receive the clips 118. The clips 118 are oriented such that their plane aligns with the slot 117, and then the clips 118 are inserted therein. Upon passing through the slots 117, the clips 118 serve to secure those ends of the fabric tubes 116 to the slotted base plate 119. The clips 118 need not be rectangular in shape, other shapes may be used to secure the far end of the fabric tubes 116. Alternatively, the clips 118 could be initially separate from the fabric tubes 116, and merely added to secure the fabric tubes 116 to the base plate 119 once passed through the slots 117.

What is claimed is:

1. A golf bag comprising:

individual club-separating compartments having a collar at the club shaft receiving end of the golf bag;

a tubular body including several club-separating cells and a lower base secured within the outer shell of the golf bag;

said collar having openings arranged in a honeycomb-like cell structure;

said club separating cells running the length of said golf bag, said lower base forming the bottom end of the cell structure; and said club separating cells are constructed from a tubular structure, secured within said collar and said base of said golf bag;

wherein said cell openings in said collar are elongate, whereby upon the club shafts being received by the golf bag rows of the club heads are separated to prevent damage to adjacent rows of clubs; and wherein said tubular structure is constructed from fabric tubing which forms the walls of the individual cells; and further comprising a plurality of clips for securing the fabric tubing to the base; and wherein said base has a plurality of slots sized to receive said fabric tubing; and wherein said clips are attached to said fabric tubing and planar in shape, and said base has a plurality of slots sized to accept said clips, such that once the clips are inserted into the slots and exit the slots the fabric tubing is secured to the base.

2. The golf bag as recited in claim 1 wherein said cell openings in said collar are spaced apart in an oblong honeycomb-like configuration to provide separation between rows of clubs for ease of insertion and removal.

3. The golf bag as recited in claim 1 wherein said tubular structure is constructed from semi-rigid thin-wall fabric-lined plastic tubing having a generally circular cross section which forms the wall of the individual cells.

4. The golf bag as recited in claim 1 wherein distal ends of said tubing have an elongate cross section to conform to the shape of said cell opening on said collar and are coupled to said collar.

5. The golf bag as recited in claim 1 wherein said cell openings are in the shape of elongated diamonds.

6. The golf bag as recited in claim 1 wherein said cell openings are in the shape elongated hexagons.

7. The golf bag as recited in claim 1 wherein said cell openings are in the shape of elongated octagons.

8. The golf bag as recited in claim 1 wherein said cell openings are in the shape of ovals.

9. The golf bag as recited in claim 8 wherein said cell openings are in the shape of elongated hexagons.

10. The golf bag as recited in claim 8 wherein said cell openings are in the shape of elongated octagons.

11. The golf bag as recited in claim 8 wherein said cell openings are in the shape of ovals.

12. The golf bag as recited in claim 8 further comprising a plurality of support rods connected at one end to the collar at the opposite end to the base.

13. The golf bag as recited in claim 8 wherein distal ends of said fabric tubing have a grommet sized to be inserted into said collar openings for securing the fabric tubing to the collar.

14. The golf bag as recited in claim 13 wherein said collar openings and said grommets are correspondingly conically shaped having decreasing diameters from the club shaft receiving end to inside the tubular body of the golf bag, such that the grommets nest inside the collar openings.

15. The golf bag as recited in claim 14 wherein each of the openings in the collar has a ledge to secure the grommets therein.

16. The golf bag as recited in claim 8 wherein said cell openings are in the shape of elongated diamonds.

* * * * *

UNITED STATES PATENT AND TRADEMARK OFFICE

CERTIFICATE OF CORRECTION

PATENT NO. : 6,619,475 B2
DATED : September 16, 2003
INVENTOR(S) : Chang, David

It is certified that error appears in the above-identified patent and that said Letters Patent is hereby corrected as shown below:

Title page,
Item [75], Inventors, the inventor's zip code is -- 91436 --

Drawings,
Sheet 11, replace Fig. 7B with the attached drawing.

Signed and Sealed this

Twenty-seventh Day of July, 2004

JON W. DUDAS
*Acting Director of the United States Patent and Trademark Office*